US007132907B2

(12) United States Patent
Chambelin et al.

(10) Patent No.: US 7,132,907 B2
(45) Date of Patent: Nov. 7, 2006

(54) FREQUENCY-SEPARATOR WAVEGUIDE MODULE WITH DOUBLE CIRCULAR POLARIZATION

(75) Inventors: Philippe Chambelin, Chateaugiron (FR); Patrice Hirtzlin, Betton (FR); Jean-Yves Le Naour, Pacé (FR)

(73) Assignee: Thomson Licensing, Boulogne-Billancourt (FR)

( * ) Notice: Subject to any disclaimer, the term of this patent is extended or adjusted under 35 U.S.C. 154(b) by 13 days.

(21) Appl. No.: 10/494,983

(22) PCT Filed: Oct. 24, 2002

(86) PCT No.: PCT/EP02/12018

§ 371 (c)(1),
(2), (4) Date: Oct. 22, 2004

(87) PCT Pub. No.: WO03/041214

PCT Pub. Date: May 15, 2003

(65) Prior Publication Data

US 2005/0040914 A1 Feb. 24, 2005

(30) Foreign Application Priority Data

Nov. 7, 2001 (FR) ..... 01 14506

(51) Int. Cl.
*H01P 5/12* (2006.01)

(52) U.S. Cl. ..... 333/135; 333/21 A; 333/126

(58) Field of Classification Search ..... 333/21 A, 333/21 R, 122, 126, 132, 135
See application file for complete search history.

(56) References Cited

U.S. PATENT DOCUMENTS 3,958,193 A * 5/1976 Rootsey ..... 333/125
6,166,699 A 12/2000 Khammouni et al.
6,812,804 B1 * 11/2004 Rosenberg et al. ..... 333/21 A

FOREIGN PATENT DOCUMENTS

| | | |
|---|---|---|
| EP | 178259 | 4/1986 |
| EP | 577320 | 1/1994 |
| WO | 99/14815 | 3/1999 |

OTHER PUBLICATIONS

V.K. Lakshmeesha et al "A compact high power S-band dual frequency, dual polarized feed" Proceedings of the Antennas and Propagation Society Annual Meeting. 1991, New York, NY, vol. 2, Jun. 24, 1991, pp. 1607-1610.
Copy of search report dated Jan. 2, 2003.

* cited by examiner

*Primary Examiner*—Benny Lee
*Assistant Examiner*—Kimberly E Glenn
(74) *Attorney, Agent, or Firm*—Joseph J. Laks; Robert D. Shedd; Brian J. Cromarty

(57) ABSTRACT

The module comprises an input/output access point at a first end of a waveguide with a square cross section, called a square waveguide, two access points made of waveguides with a rectangular cross section, called rectangular waveguides, placed side by side at a second end of the square waveguide and a septum positioned in the square waveguide at the end of a separation region common to the two rectangular waveguides in order to allow the production of two circular polarizations of opposite handedness each associated with a rectangular waveguide. The module is arranged so as to form a diplexer in which the septum is included and where the access points by rectangular waveguide are extended by filters, each access point being endowed with a filter provided in order to transmit a frequency band which is different. The steps of the septum are dimensioned so as to compensate for reflections.

8 Claims, 5 Drawing Sheets

FREQUENCY-SEPARATOR WAVEGUIDE MODULE WITH DOUBLE CIRCULAR POLARIZATION

This application claims the benefit, under 35 U.S.C. § 365 of International Application PCT/EP02/12018, filed Oct. 24, 2002, which was published in accordance with PCT Article 21 (2) on May 15, 2003 in English and which claims the benefit of French patent application No. 0114506, filed Nov. 7, 2001.

BACKGROUND OF THE INVENTION

1. Field of the Invention

The invention relates to a frequency-separator waveguide module with double circular polarization more particularly intended to serve as an antenna access module for a transmitter-receiver operating simultaneously in two frequency bands and with circular polarizations which are opposite for transmission and for reception.

2. State of the Art

This type of transmitter-receiver and, consequently, this type of module are especially intended to be used in systems transmitting and receiving at high bit rates via low-orbit satellites. The possibility of simultaneous transmission and reception with the same access point to a system means that it is possible to obtain high isolation between the transmission path and the reception path, at the antenna access point, and double circular polarization with a high degree of purity of polarization over a large frequency band. Right circular polarization for the transmission path and left circular polarization for the reception path are, for example, chosen. Cross-polarization of less than −25 dB, corresponding to an axial ratio of less than 1 dB, at the transmission access point and at the reception access point is, for example, sought.

A conventional approach for obtaining circular polarization from a linearly polarized field is shown diagrammatically in FIG. 1. Said approach combines an exciter 1 with a polarizer 2 made using waveguide technology. The exciter 1 separates a frequency band Tx used in transmission and a frequency band Rx used in reception. The polarizer 2 generates circular polarization, the handedness of which depends on the orientation of the electric field vector, as symbolized by the labels RCP and LCP, one assumed to correspond to right polarization and the other to left polarization.

A known waveguide component which makes it possible to produce such circular polarizations is a system with a central septum where steps produced on the septum border create a horizontal field which recombines with a vertical input field in order to produce circular polarization. In a known embodiment, shown schematically in FIG. 2, the polarizer 2 comprises two access points 3A, 3B made of waveguide with a rectangular cross section, symmetrically arranged with respect to a central plane of line XX', which join each other at an end which is extended by a septum 4, in order to open out into a waveguide portion 5 with a square cross section where the septum is placed. The right or left circular polarization is obtained by the progressive creation of a horizontal electrical field vector, by the steps on the plate forming the septum 4 and the recombination of this horizontal vector with the vertical vector corresponding to the linear polarization of the access point 3A or 3B from which it comes. The two access points 3A and 3B therefore make it possible to produce two circular polarizations having orientations which are opposite for two different frequency bands at the access point 3C which constitutes the end of the portion 5 with a square cross section. The latter may possibly be fitted with a normal transition (not shown), making it possible to pass from a square section to a circular section, if necessary.

The separator 1 is combined with the polarizer 2 in order to separate the transmission Tx and reception Rx paths for each of the access points 3A and 3B. Provision is made to absorb, via a load, the band which is not useful at each of these access points 3A, 3B.

This is because, if the access points 3A and 3B are used alone, without a separator as envisaged above, there is a reflection of the frequency band which is not used at one access point, that is therefore of the band used for reception in the case of an access point used in transmission and vice versa. The consequence of these reflections in the direction of the septum results in mismatching of the polarizer. This is the reason for inserting a load, in this case assumed to be 50 ohms, in one arm and, for example, in an arm 6A parallel to the arm 7A at the access point 3A where the arm 7A is used for transmission, and the reason for inserting a similar load in the arm 6B parallel to the arm 7B at the access point 3B where the arm 7B is used for reception.

However, this solution has the drawback of being bulky because of the use of a separator with multiple arms for access. Furthermore, it is expensive since the components employed, such as the filters, the transitions and the septum, are awkward to produce and assemble.

SUMMARY OF THE INVENTION

The invention therefore provides a frequency-separator waveguide module with double circular polarization more particularly intended to act as an antenna access module for a transmitter-receiver operating simultaneously in two frequency bands and with polarizations which are opposite for transmission and in reception.

The frequency-separator waveguide module comprises input/output access point to a first end of a waveguide with a square cross section, called a square waveguide, two access points made of waveguides with a rectangular cross section, called rectangular waveguides, placed side by side at a second end of the square waveguide and a septum positioned in this square waveguide at the end of a central separation region common to the two rectangular waveguides in order to allow the production of two circular polarizations of opposite handedness each associated with one of the rectangular waveguides.

According to one feature of the invention, the module is arranged so as to form a diplexer in which the septum is included and where the access points by rectangular waveguide are extended by filters, each access point being endowed with a filter provided in order to transmit a frequency band which is different, the steps of the septum being dimensioned so as to compensate for the reflections of the frequencies respectively rejected by each filter towards the said septum.

The invention also provides a transmitter-receiver for operating simultaneously in two frequency bands and with circular polarizations which are opposite for transmission and for reception.

According to one characteristic of the invention, this transmitter-receiver comprises an antenna access module consisting of a waveguide module as defined above.

BRIEF DESCRIPTION OF THE DRAWINGS

The invention, its features and its advantages are specified in the following description in connection with the figures mentioned below.

DETAILED DESCRIPTION OF THE PREFERRED EMBODIMENT

Figure 3:
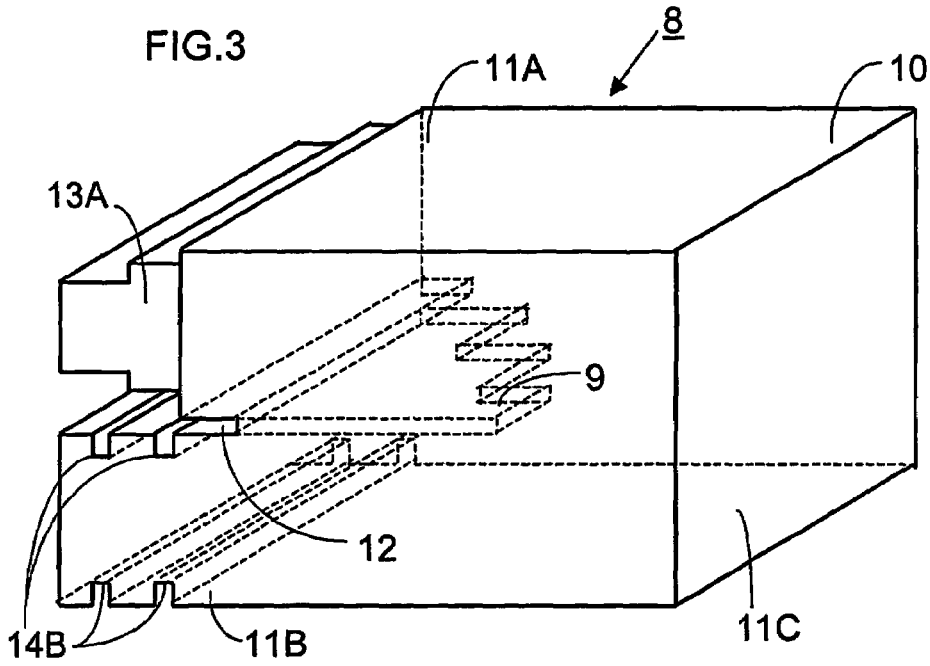
FIG. 3 shows a schematic view relating to a waveguide module for access according to the invention.

A frequency-separator waveguide module with double circular polarization, according to the invention, is shown schematically in FIG. 3. The module includes a diplexer 8 in which a septum 9 with multiple steps is positioned, which septum is used as a polarizer. This septum is housed inside a waveguide portion 10 with a square cross section, here shown in dashed lines. The diplexer has two access points 11A and 11B consisting of short waveguide elements which are parallel and which have a rectangular cross section, one of them, such as the access point 11A, being intended to be used in transmission and the other, such as the access point 11B, in reception. The waveguide elements with a rectangular cross section corresponding to these access points 11A, 11B are connected to the waveguide portion 10 on each side of a central and common separation region 12 penetrating the waveguide portion 10 at one end. In the proposed exemplary embodiment, the septum 9 consists of a thin plate with steps which has a base positioned at the end of the separation region 12 inside the waveguide portion 10. The steps, which it has laterally and which reduce it from its base towards its apex, lie in a first part of this waveguide portion. Moreover, the diplexer comprises a square access point 11C which opens at the end of the waveguide portion 10 which is away from the end where the two rectangular access points 11A and 11B open. These two access points are each provided for a particular frequency band which is different. This structure is used to obtain a module with a dual-band septum. To this end, the two access points 11A and 11B, which are completely independent from each other, are respectively equipped to allow each to filter one of the two frequency bands.

Filtering at a high frequency band may be carried out naturally by reducing the cross section at a rectangular access point in the extension of this access point, as shown diagrammatically by the reducing element 13A forming a filter for the access point 11A in FIG. 3. The cut-off frequency is changed to prevent the propagation of low frequencies.

Filtering at a low frequency band is carried out at the other rectangular access point, here it is assumed to be obtained by positioning transverse metal inserts or "stubs" in a portion located in the extension of this access point, as symbolized by the inserts 14B placed internally on each side of the rectangular waveguide portion relative to the access point 11B.

Figure 1:
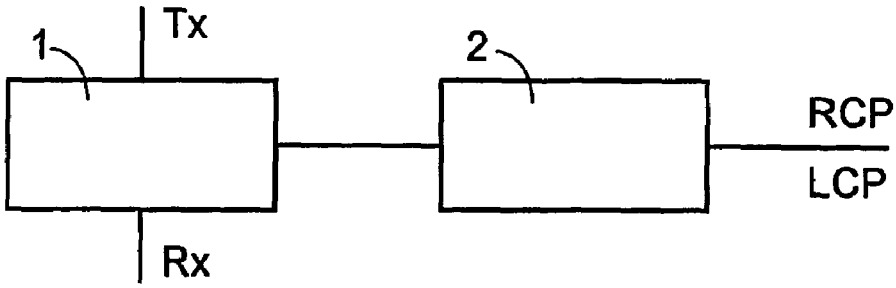
FIG. 1 Prior art
FIG. 1 shows an outline diagram of a waveguide device according to the prior art making it possible to obtain circular polarization from a linearly polarized field.
Figure 2:
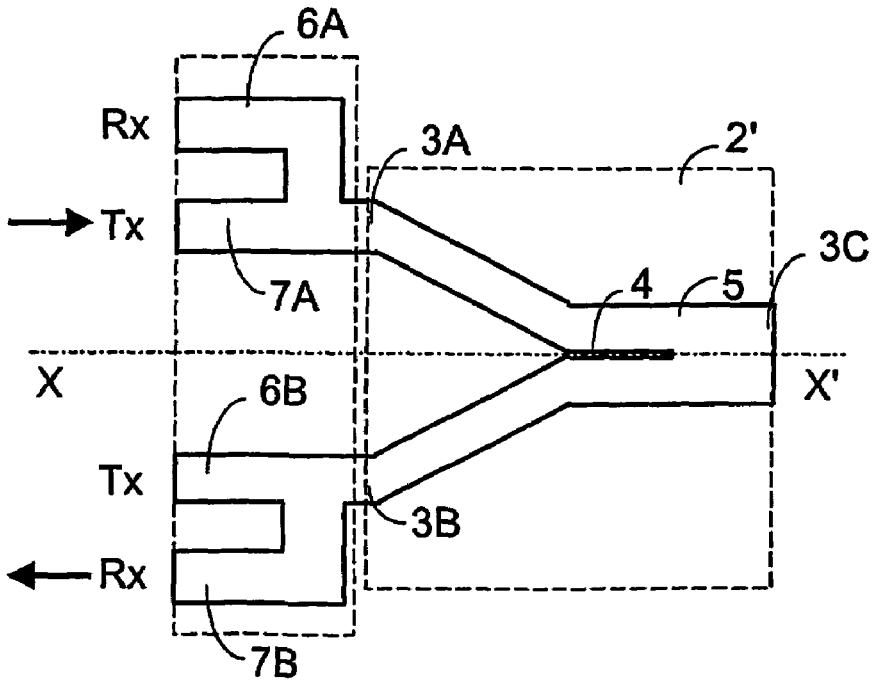
FIG. 2 Prior art
FIG. 2 shows a schematic view relating to a known waveguide module for access to an antenna.

A significant saving with regard to overall size is obtained for a module according to the invention if this module is compared with a module according to the prior art having a separator with four arms, as described in relation to FIG. 2. This facilitates integrating the module according to the invention in an assembly where it is needed, and in particular as an access circuit for an antenna in the case of a transmitter-receiver as envisaged above.

Figure 4:
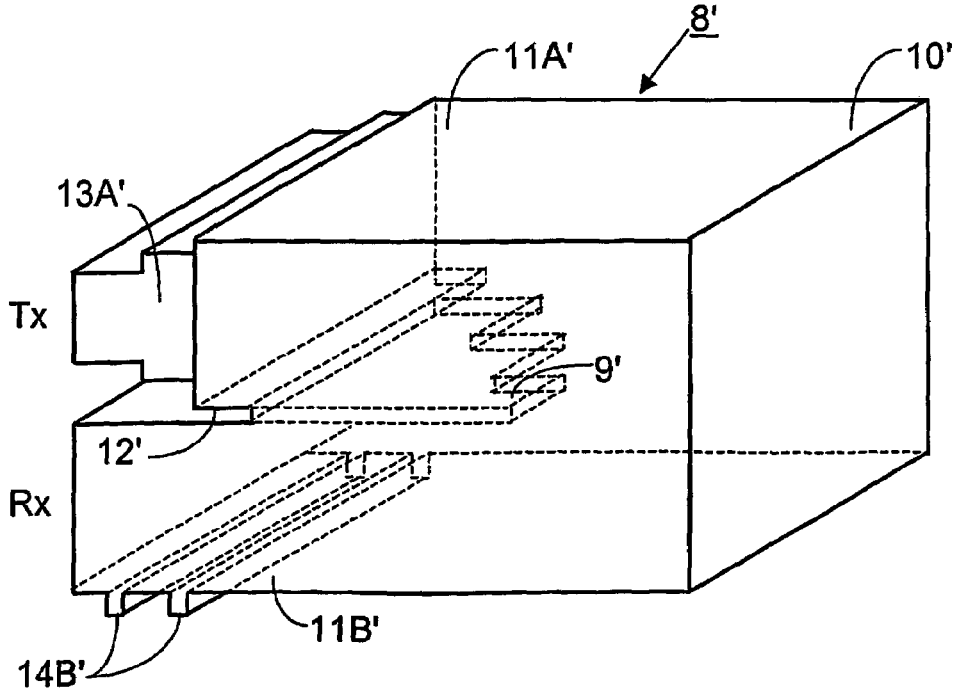
FIG. 4 shows a perspective view relating to an alternative embodiment of an access module according to the invention.

The solution proposed in connection with FIG. 3 is not unique and, in particular for reasons of compactness and of simplifying the mechanical production of the module, a solution as shown diagrammatically in FIG. 4 is provided.

The module shown in this FIG. 4 consists of a diplexer 8' similar to the diplexer 8 shown in FIG. 3. This diplexer 8' identically comprises a waveguide portion 10' with a square cross section where a septum 9' is placed. The diplexer 8' has two access points, with a rectangular cross section, 11A' and 11B' placed side by side, like the access points 11A and 11B of the diplexer 8. One of these rectangular access points, in this case 11A', is extended by a reducing element of cross section 13A', which is constructed like the access point 11A and which also allows filtering at a high frequency band. The other rectangular access point, in this case 11B', is equipped to filter at a low frequency band and here it is extended by a portion where transverse metal inserts 14B' are made externally. In the proposed example, these inserts 14B' are made in the form of transverse grooves opening towards the inside of the rectangular waveguide portion where they are made on at least one of the rectangular and flat wall parts which laterally define this waveguide portion. In the proposed embodiment, the grooves are made in regions which project outwards from the volume from that flat wall part which is outermost. A mechanical embodiment which is particularly simple to implement may therefore be obtained.

Whichever of the solutions according to the invention is chosen, the fact remains that the filtering carried out by means positioned in the extension of the rectangular access points of the module tend to introduce perturbations in the transmission coefficients of this module, with respect to those which would be obtained by means of the septum used without filters.

A waveguide module according to the invention intended for a transmitter-receiver, transmittering in a frequency band Tx extending from 14 to 14.5 GHz and receiving in a band Rx extending from 11.7 to 12.7 GHz is presupposed. Moreover, it is presupposed that there is a need to have an axial cross polarization greater than −25 dB and an insulation greater than 20 dB in the transmission and reception bands.

The septum provided in the module conditions the quality of insulation obtained to the extent that the latter depends directly on the discriminating power of the cross polarization.

A polarizer with a septum having a band extending from 11.7 to 14.5 GHz is assumed to be chosen, as it is known that its bandwidth is a function of the number of steps which the thin plate of which it is composed has and that it is possible to obtain an axial ratio of about 0.6 dB for the frequency band envisaged above with a septum having four steps.

Assuming rectangular access points, made using waveguides in the WR75 standard of, for example, 19.05 by 9.525 mm, and a square waveguide of 20 by 20 mm, it is possible to obtain a good match with the envisaged bandwidth, the cut-off frequency for the TE10 transverse electrical mode being 7.49 GHz. Furthermore, the TE20 transverse electrical mode is not likely to be excited since its cut-off frequency is 14.99 GHz.

The step length is about a quarter of the guided wavelength λg, which corresponds to 6.97 mm at the central frequency of 13.1 GHz and which leads to a septum plate length of about 35 mm.

As is known, the quality of the excitation depends on the position of the exciting probe with respect to the short-circuit end of the guide where it acts and this position corresponds to a movement of the probe away from this end by about a quarter wavelength λg. Here, the septum is assumed to be placed at a distance from the probe of about λg, so that it is possible to drive the septum in the fundamental mode.

To obtain good quality circular polarization, the phases of the orthogonal modes present in the square waveguide are shifted by 90° and have the same amplitude so as to have transfer coefficient values S13 and S23 of 3 dB for each of the modes exploited. S13 corresponds to the transfer coefficient between ports 1 and 3 and S23 to the transfer coefficient between ports 2 and 3, the ports 1, 2 and 3 corresponding respectively to the access points 11B, 11A and 11C of FIG. 3. Moreover, the modes 1 and 2 correspond respectively to a vertical orientation of the electrical field and to a horizontal orientation of this field.

Figure 5:
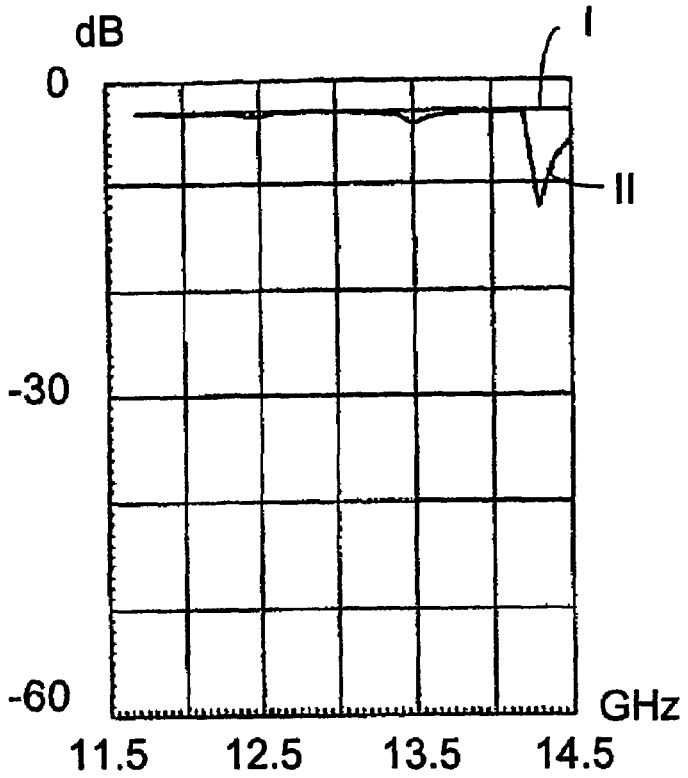
FIG. 5 shows a diagram representing performances likely to be obtained with a septum according to the prior art, within the context of an access module with no filter at the two rectangular access points.

The diagram presented in FIG. 5 illustrates the performance obtained with a septum having four steps, according to the prior art, provided in a module according to the invention and as defined above, without filters at the two rectangular access points of the module.

The width of the frequency band involved is from 11.5 to 14.5 GHz, as shown on the X-axis, a graduation of 0 to −60 dB being provided on the Y-axis. The performance is virtually identical for the transfer coefficients S13 and S23 in mode 1, as shown diagrammatically by a virtually horizontal curve 1. This is virtually the same for the transfer coefficients S13 and S23 in mode 2, as shown diagrammatically by a curve 11 which dips slights in the vicinity of the frequencies 12.5 and 13.5 GHz and which has a negative peak reaching more than −10 dB in the vicinity of 13.6 GHz frequency. Modes 1 and 2 correspond respectively to the vertical and horizontal polarizations of the electrical field.

Curves 1 and 11 show that the limit of 3 dB is held for frequencies between 11.8 and 14.3 GHz and therefore for the entire receiving frequency band, in contrast this limit is not held for all the frequencies of the transmission band and in particular in the vicinity of the 13.6 GHz frequency, already mentioned above. Provision is therefore made to optimize performance at this level.

Figure 6:
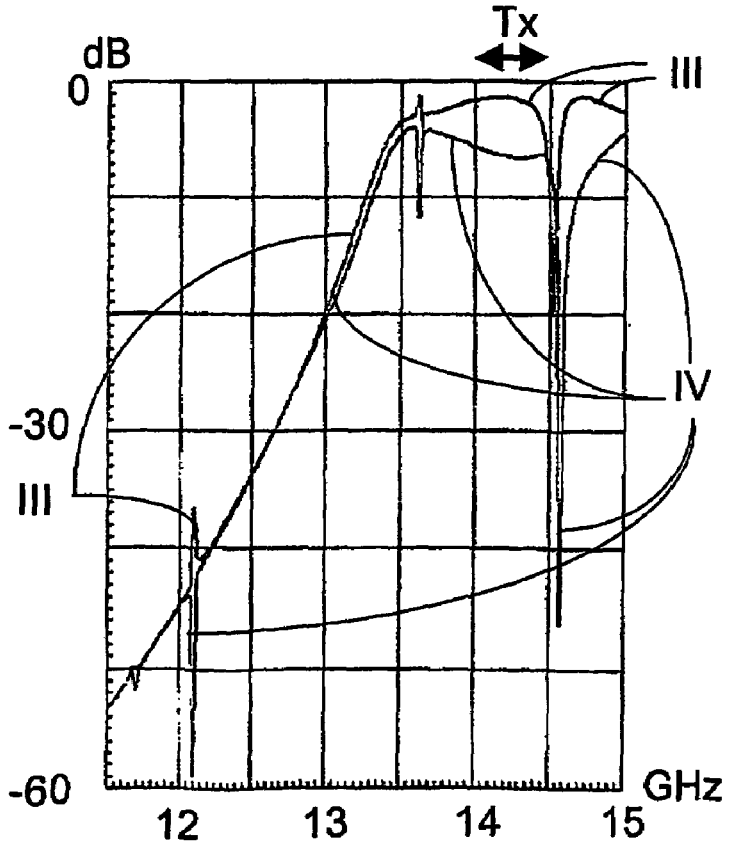
FIGS. 6 and 7 show diagrams representing performances obtained before optimization showing the perturbations introduced, when the septum is combined with filters located in the extension of the rectangular access points within the context of a module according to the invention.
Figure 7:
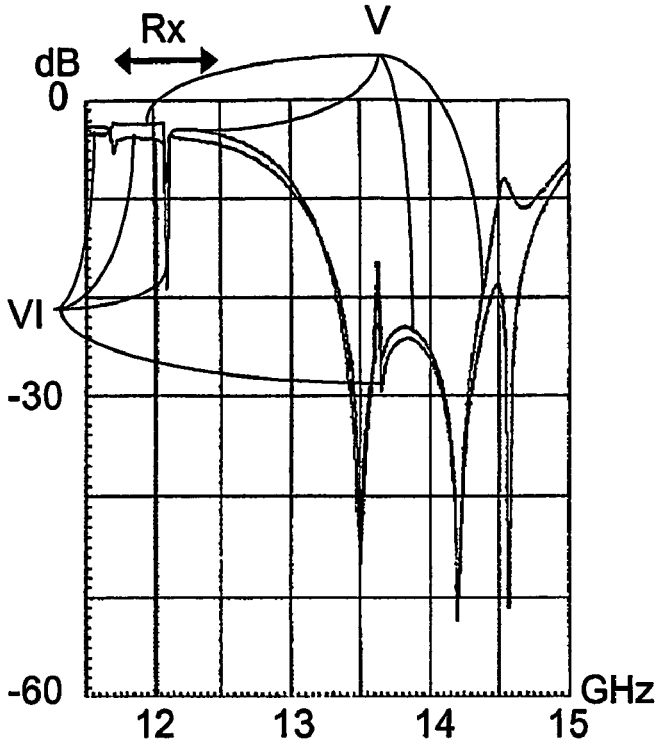

The diagrams presented in FIGS. 6 and 7 show the perturbations which are caused by the presence of the filters placed in the extension of the rectangular access points, each for purposes of selectively eliminating the frequency band which is not transmitted by the access point in question, as indicated above.

Figure 8:
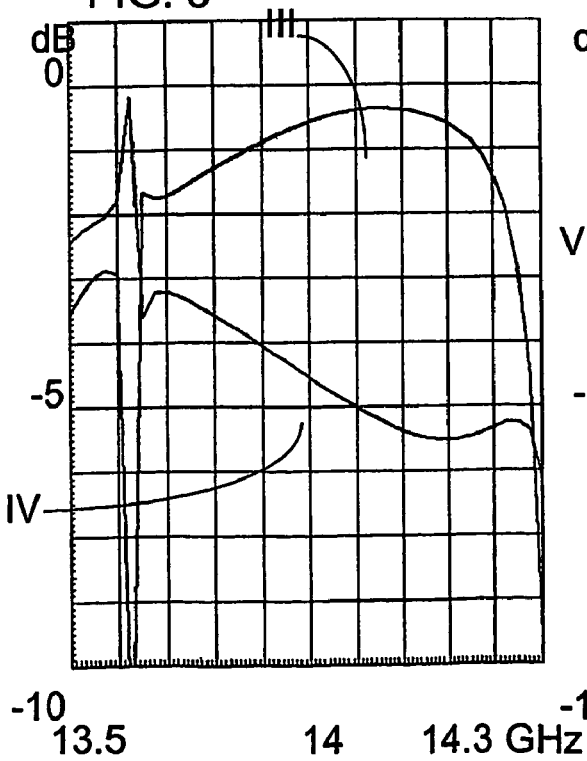
FIGS. 8 and 9 show diagrams representing performances more particularly obtained, before optimization, at the transmission and reception bands taken by way of example, with the filterless septum envisaged above.

Curves III and IV presented in FIG. 6 show the respective performance obtained for the coefficient S23 in mode 1 and 2. The curve III relating to the coefficient S23 in mode 1 is virtually coincident with the curve IV for the range of frequencies going from 11.5 GHz to 13.5 GHz with the exception of a region located in the vicinity of the frequency 12.1 GHz where the curve III has a peak going up to about −36 dB and where the curve IV has a peak going down to −59 dB. The two curves separate especially around the frequency 13.65 GHz where the curve IV has a peak going down to −12 dB while the curve III has a peak going up to −3 dB. The parts of curve III and IV which are located in the frequency band roughly between 13.7 and 14.5 GHz, within which the frequency band Tx of 14 to 14.5 GHz exploited in transmission is found, are enlarged in FIG. 8 for this band. The curve II, relating to the transfer coefficient S23 in mode 1, is between −1 and −3 dB for a frequency band ranging from 13.7 to 14.4 GHz and the curve IV, relating to the transfer coefficient S23 in mode 2, is between −4 and −7 dB for a frequency band ranging from 13.7 to 14.5 GHz. Such a module does not allow the desired performance to be obtained. The invention aims to act on the construction of the septum in order to compensate for the perturbations, created in the transmission band, by readjustment of the steps which the thin plate forming the septum has, by modifying, by trial and error, the length and the depth of the various steps.

The curves V and VI presented in FIG. 7 show the respective performance obtained for the coefficient S13 in mode 1 and in mode 2 in a frequency band extending from 11.5 to 15 GHz.

Figure 9:
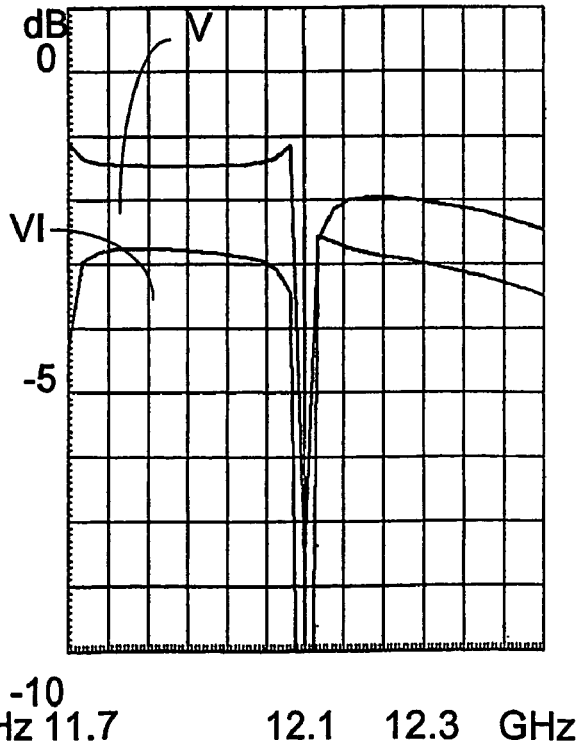

The curves V and VI are in a region between −2 and −5 dB between the frequencies of 11.5 and 12.7 GHz, where the frequency band Rx exploited in reception is located, with the exception of a limited region, virtually centred on the frequency 12.1 GHz, where the two curves show a downward peak. FIG. 9 corresponds to an enlargement of the parts of curves V and VI between the limiting frequencies of 11.7 and 12.5 GHz of the receiving band.

A low point at more than −10 dB is noticed for the curve V, relating to the coefficient S13 in mode 1, with a lower point of −19 dB for the curve VI relating to the coefficient S13 in mode 2 (FIG. 7).

Figure 10:
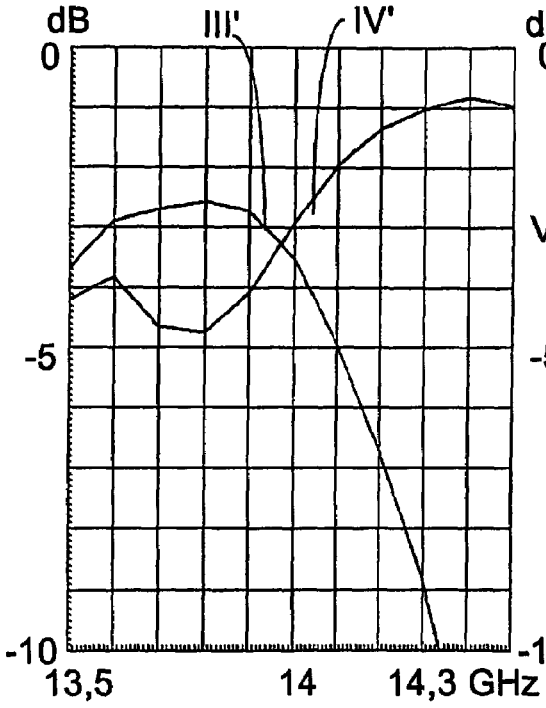
FIGS. 10 and 11 show enlarged diagrams relating to the performances more particularly obtained, after optimization, for the transmission and reception bands taken by way of example, with the septum fitted with filters.
Figure 11:
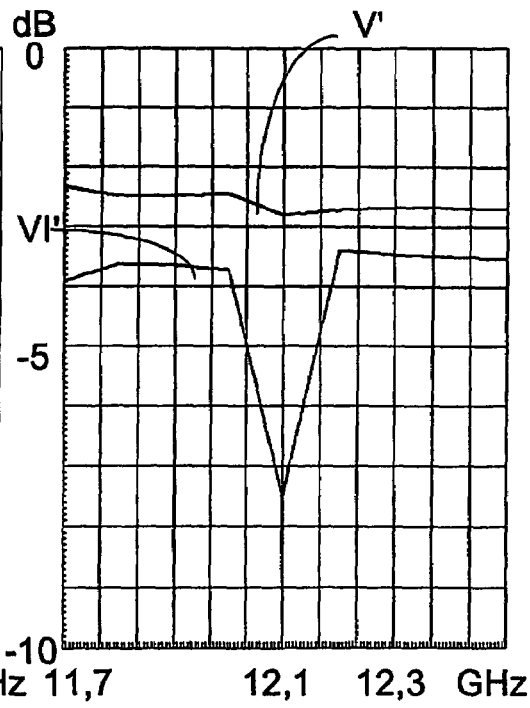

In a module according to the invention, these perturbations, which are caused by the filtering and which affect the transmission coefficients, are compensated for by a dimensional readjustment of the steps of the septum. This readjustment is carried out in steps until an optimum result, which is illustrated here in FIGS. 10 and 11, is obtained. The curves III', IV', V' and VI' presented in these figures show respectively the variations of the coefficients S23 in mode 1 and 2 and S13 in mode 1 and 2 measured in dB and given as a function of the frequency, after optimization, for the envisaged module according to the invention. The reduction of the negative peaks presented by the curves V' and VI' in FIG. 11 compared to the corresponding curves V and VI in FIG. 9 should be noted in particular.

If, for example, equality of amplitude for the transmitted orthogonal modes is chosen as an optimization factor for each access point, it may be translated in the form of the following criteria:

S13 mode 1=S13 mode 2=−3 dB over the 11.7 to 12 GHz band S23 mode 1=S23 mode 3=−3 dB over the 13.9 to 14.1 GHz band.

Improving the performance over the optimized bands more particularly results in the values obtained from the curves presented above which appear in the table given below by way of example.

Considering the septum with four steps envisaged above, which is assumed to have a base of 20 mm and four steps whose width is respectively 15.69 mm, 9.62 mm, 5.67 mm and 2.56 mm, an optimized septum is proposed here having the same base as before and four steps whose widths are respectively 16.79 mm, 9.32 mm, 6.71 mm and 2.58 mm.

According to the table mentioned above, the following is obtained:

| | | before optimization | after optimization |
|---|---|---|---|
| S13 mode 1–S13 mode 2 | to 11.7 GHz | 3 dB | 1.6 dB |
| | to 12 GHz | 1.7 dB | 1.3 dB |
| S23 mode 1–S23 mode 2 | to 13.9 GHz | 3.2 dB | 1.3 dB |
| | to 14.1 GHz | 5.6 dB | 2.6 dB |

A difference of 1.3 dB between the amplitudes, with a phase shift of between 84 and 90°, leads to an axial ratio better than 1.75 dB.

Insofar as the phase has not been taken into account within the context of this optimization, it is possible to carry out an additional adjustment by changing the length of the steps of the septum.

Modifying the width of the septum steps makes it possible to compensate for the defects caused by the filters placed in the extension of the rectangular access points. Dimensioning these steps makes it possible to compensate for the reflections of the frequencies which are respectively rejected by each filter towards the septum. The optimization is, for example, carried out by trial and error by varying the size of the steps and by producing simulations for each variation.

The polarizer with a dual-band septum which is obtained makes it possible to produce a frequency-separator waveguide module with double circular polarization. This module is more particularly intended to act as a link between an antenna and a transmitter-receiver intended to operate simultaneously in two frequency bands with circular polarizations which are opposite for transmission and for reception. The transmitter is connected to one of the rectangular access points which, in this case, is assumed to be the access point 11A, or 11A', equipped with a reducing element 13A or 13A', if the transmitting frequency band is higher than that of reception, as envisaged here. The receiver is connected to the other rectangular access point and the antenna is connected to the access point located at the other end of the square waveguide portion 10 or 10'.

The invention claimed is:

1. Frequency-separator waveguide module, comprising a diplexer with an input/output access point at a first end of a waveguide with a square cross section, called a square waveguide, two access points made of waveguides with a rectangular cross section, called rectangular waveguides, placed side by side at a second end of the square waveguide, and wherein the diplexer includes a septum positioned in this square waveguide at the end of a central separation region common to the two rectangular waveguides in order to allow the production of two circular polarizations of opposite handedness each associated with one of the rectangular waveguides, each access point by said rectangular waveguides is extended by a filter provided in order to transmit a different frequency band and the septum is a blade in a form of steps which are dimensioned so as to compensate for the reflections of the frequencies respectively rejected by each filter towards the said septum.

2. Module according to claim 1, in which one of the rectangular access point filters consists of an element providing natural filtering by one or more reductions of cross section, for the access point by rectangular waveguide in the extension of which it is located.

3. Module according to claim 2, in which an other of the rectangular access point filters is constructed with the help of transverse metal inserts placed internally on each side of a portion which extends the waveguide with a rectangular cross section of this access point.

4. Module according to claim 2, in which an other of the rectangular access point filters is constructed with the help of inserts constructed in the form of transverse grooves opening towards the inside of the rectangular waveguide portion in which they are produced on at least one of the rectangular wall parts which laterally define this rectangular waveguide portion.

5. Transmitter-receiver designed to operate simultaneously in two frequency bands and with circular polarizations which are opposite for transmission and for reception, said transmitter-receiver comprising an antenna access module consisting of a waveguide module that comprises a diplexer with an input/output access point at a first end of a waveguide with a square cross section, called a square waveguide, two access points made of waveguides with a rectangular cross section, called rectangular waveguides, placed side by side at a second end of the square waveguide, and wherein the diplexer includes a septum positioned in this square waveguide at the end of a central separation region common to the two rectangular waveguides in order to allow the production of two circular polarizations of opposite handedness each associated with one of the rectangular waveguides, each access points by said rectangular waveguides is extended by a filter provided in order to transmit a frequency band which is different, the septum is a blade in the form of steps which are dimensioned so as to compensate for the reflections of the frequencies respectively rejected by each filter towards the said septum.

6. Transmitter-receiver according to claim 5, in which one of the rectangular access point filters consists of an element providing natural filtering by one or more reductions of cross section, for the access point by rectangular waveguide in the extension of which it is located.

7. Transmitter-receiver according to claim 6, in which an other of the rectangular access point filters is constructed with the help of transverse metal inserts placed internally on each side of a portion which extends the waveguide with a rectangular cross section of this access point.

8. Transmitter-receiver according to claim 6, in which an other of the rectangular access point filters is constructed with the help of inserts constructed in the form of transverse grooves opening towards the inside of the rectangular waveguide portion in which they are produced on at least one of the rectangular wall parts which laterally define this rectangular waveguide portion.

* * * * *